US005192934A

United States Patent [19]

Milianowicz et al.

[11] Patent Number: 5,192,934

[45] Date of Patent: Mar. 9, 1993

[54] CIRCUIT BREAKER HAVING A TRIP ACTUATOR

[75] Inventors: Stanislaw A. Milianowicz, Monroeville; Nagar J. Patel, Plum Boro; William O. Aglietti, Penn Hills Township, Allegheny County, all of Pa.; Brian F. McDonnell, Charlotte, N.C.

[73] Assignee: Westinghouse Electric Corp., Pittsburgh, Pa.

[21] Appl. No.: 788,697

[22] Filed: Nov. 6, 1991

[51] Int. Cl.[5] ..... H01H 9/00

[52] U.S. Cl. ..... 335/172; 335/167

[58] Field of Search ..... 335/167-176, 335/16, 147, 195, 21-24

[56] References Cited

U.S. PATENT DOCUMENTS

| | | | |
|---|---|---|---|
| 3,544,931 | 12/1970 | Patel . | |
| 3,760,307 | 9/1973 | Patel . | |
| 3,783,422 | 1/1974 | Taylor | 335/174 |
| 4,237,439 | 12/1980 | Nemoto | 335/179 |

OTHER PUBLICATIONS

Pages 26, 27, 62, 63, IB 33-790 IF, Low Voltage Power Circuit Breakers Types DS and DSL, Westinghouse Electric Corporation, Oct. 1983.

*Primary Examiner*—Lincoln Donovan
*Attorney, Agent, or Firm*—M. J. Moran

[57] ABSTRACT

A circuit breaker having a trip actuator which mechanically trips the breaker in response to an electrical trip pulse. The trip actuator includes first and second parallel magnetic circuits, with the first circuit having a lower reluctance than the second circuit. A magnet provides magnetic flux for both circuits. A pivotally mounted clapper has a first position in which it is releasably held in the first circuit by a magnetic force, and a second position. Bias springs urge the clapper towards the second position, with the bias springs providing a biasing force which is less than the magnetic force holding the clapper. The electrical trip pulse creates a magnetic flux which opposes the magnetic flux in the first circuit, switching the magnetic flux to the second circuit. The clapper member pivots to the second position, and a trip link associated with the clapper actuates a trip mechanism.

16 Claims, 8 Drawing Sheets

CIRCUIT BREAKER HAVING A TRIP ACTUATOR

TECHNICAL FIELD

The invention relates in general to circuit breakers, and more specifically to circuit breakers having a trip actuator which provides a mechanical movement which trips the circuit breaker in response to an electrical trip impulse.

BACKGROUND ART

Power circuit breakers conventionally utilize a trip actuator to provide a mechanical force which trips the circuit breaker in response to an electrical tripping pulse from over-current intelligence of the circuit breaker. A prior art trip actuator disclosed in U.S. Pat. Nos. 3,544,931 and 3,760,307 includes a permanent magnet disposed in a housing. A plunger is provided which has a first end disposed within the housing, and a second end outside the housing. The plunger is disposed for guided rectilinear movement. An actuating member is fixed to the external second end of the plunger, and the plunger includes a disc within the housing. The disc is acted upon by the magnet to provide a force which tends to move the plunger out of the housing, and the plunger is further acted upon by a spring which biases the plunger in a direction which tends to retract the plunger into the housing.

The prior art trip actuator further includes first and second levers, with the first lever having a first end disposed to be actuated by the plunger actuating member when the plunger retracts into the housing, and a second end which extends to a circuit breaker trip shaft. The breaker is tripped in response to actuation of the first lever. The second lever mechanically lifts the plunger, to reset the trip actuator, in response to movement of the movable contacts of the circuit breaker as they are propelled to the open position in response to tripping of the circuit breaker.

The magnet cannot pull and reset the disc against the force of the, spring acting on the plunger, but can overcome the spring force when the disc is in contact with the magnet pole piece which creates a low reluctance first magnetic circuit. An electrical tripping pulse from an over-current trip unit of the circuit breaker counteracts the effect of the magnet, transferring the magnetic flux to a second magnetic circuit, which allows the spring to separate the disc from the magnet pole piece and move the plunger to actuate the trip shaft lever. The trip shaft lever then rotates the trip shaft and trips the breaker. As the breaker opens, a lever pin on the opening movable contact structure strikes a spring finger attached to the reset lever. This provides the assistance required to move the disc and close the air gap between the disc and the magnet, against the spring force. The device is reset when the disc contacts the magnet, re-establishing the first magnetic circuit, which has a lower reluctance than the second magnetic circuit.

While this prior art trip actuator performs well, it has a relatively high manufacturing cost, due in part to the precision required to provide a reliable rectilinear plunger movement which will operate correctly for the life of the breaker without skewing or binding. It would thus be desirable, and it is an object of the present invention, to provide a circuit breaker having a new and improved trip actuator which is less costly to manufacture than the hereinbefore mentioned prior art trip actuator, and which will operate as well as, or better, than the rectilinear type.

SUMMARY OF THE INVENTION

Briefly, the present invention is a circuit breaker having electrical contacts operable between open and closed positions, and a trip actuator which provides a mechanical movement upon receiving an electrical trip pulse from over-current monitoring control, with the mechanical movement actuating a trip mechanism of the circuit breaker to cause the electrical contacts to assume the open position. The trip actuator includes first and second parallel magnetic circuits, with the first magnetic circuit having a lower reluctance than the second magnetic circuit. A permanent magnet is disposed to provide magnetic flux for both the first and second magnetic circuits, with the flux from the magnet favoring the lower reluctance of the first magnetic circuit.

A pivotally mounted clapper member includes a first position in which it is releasably held in the first magnetic circuit by a magnetic force, and a second position which opens the first magnetic circuit.

Bias means provides a biasing force which biases the clapper member towards the second position, with the bias means being selected and arranged to provide a biasing force which is less than the magnetic force holding the clapper member in first position.

Electromagnetic means receives an electrical trip pulse from the over-current control of the circuit breaker when the circuit breaker is to be tripped, with the trip pulse causing the electromagnetic means to provide a magnetic flux which momentarily opposes the magnetic flux in the first magnetic circuit. The magnetic flux provided by the magnet is immediately switched to the second magnetic circuit, reducing the magnetic force holding the clapper member in the first position below the magnitude of the biasing force. The bias means thus pivots the clapper member to the second position.

Linking means is disposed between the clapper member and the trip mechanism of the circuit breaker, with the pivoting of the clapper member to the second position causing the linking means to actuate the trip mechanism of the circuit breaker.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
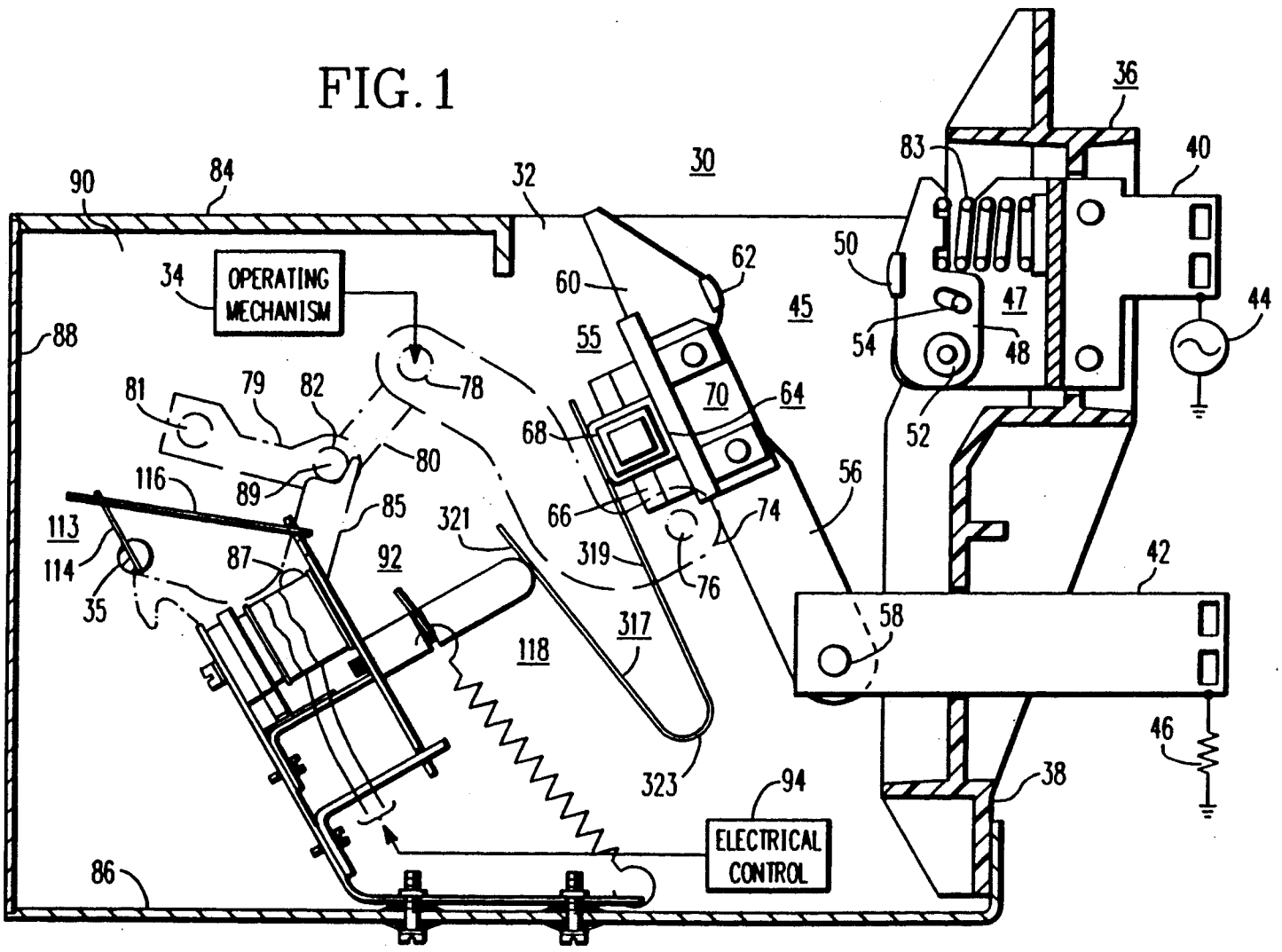
FIG. 1 is a side elevational view, partially in section, and with some parts removed, of a circuit breaker shown with its electrical contacts in an open position, and with a trip actuator shown in a reset position in which a clapper member is in at a first limit position of a predetermined pivotable range.
Figure 2:
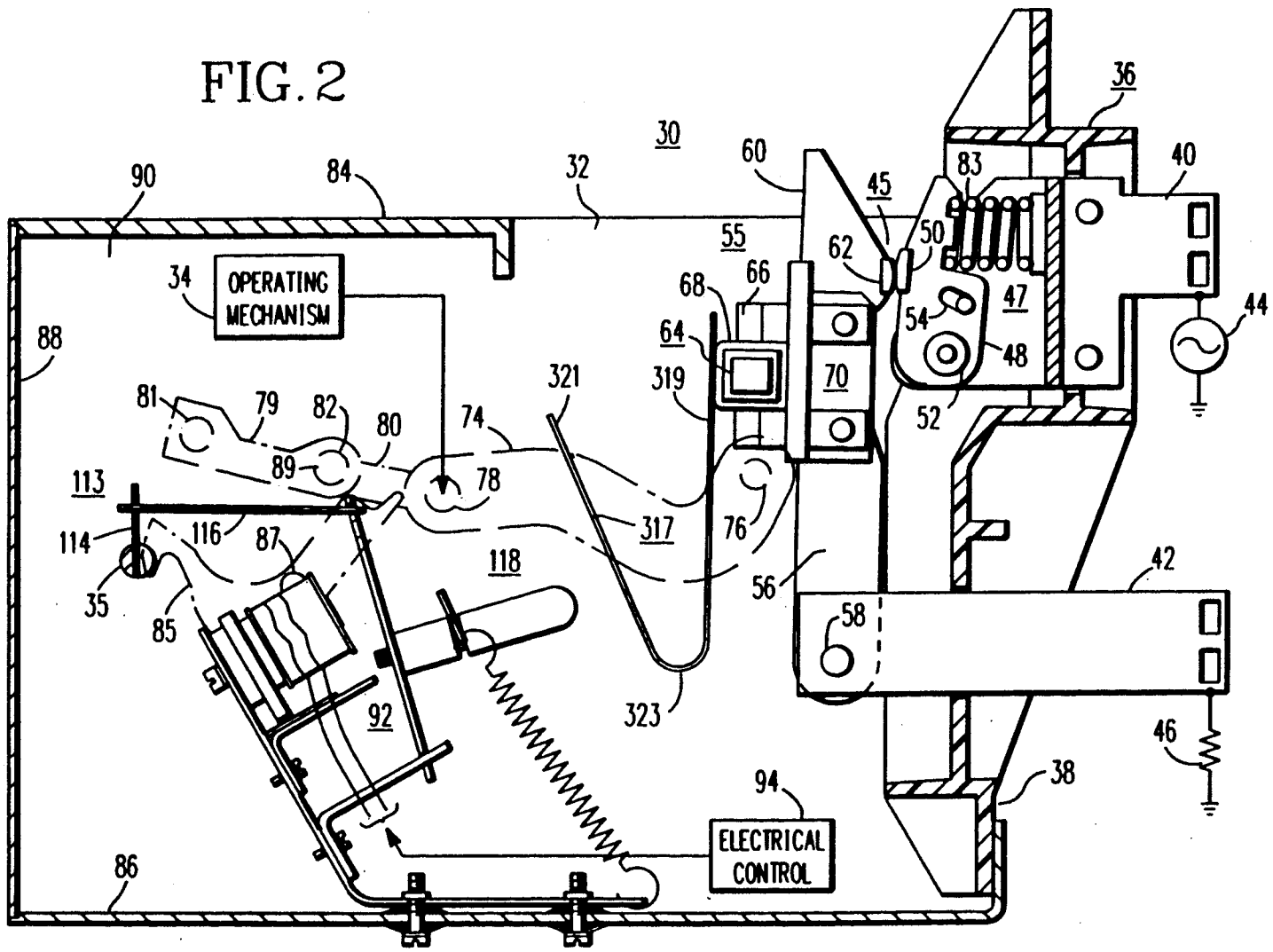
FIG. 2 is a view similar to FIG. 1, except illustrating the electrical contacts of the circuit breaker in a closed position, at the instant of tripping, with the trip actuator being illustrated in the "trip" configuration in which the clapper member has just been pivoted to a second limit position which initiates tripping of the circuit breaker.

Referring now to the drawings, and to FIGS. 1 and 2 in particular, there is shown side elevational views, partially in section, and with some parts not shown, of a circuit breaker 30 constructed according to a preferred embodiment of the invention. For purposes of example, circuit breaker 30 is illustrated as being of the AC power circuit breaker type which is usually supplied as part of low voltage metal enclosed switchgear of the drawout type, but it may also be supplied in a fixed mounted version, as desired. Further, the principles and concepts of the invention apply equally to any circuit breaker having a direct trip actuator which provides a mechanical movement to initiate tripping, in response to an electrical trip pulse provided by overcurrent monitoring intelligence associated with the circuit breaker.

Circuit breaker 30 includes a chassis 32, which may be metal, such as steel, with chassis 32 supporting all of the circuit breaker components which include an operating mechanism 34 of any suitable type, and three insulated pole assemblies 36 (with three-phase circuit breakers), only one of which is shown since they are of similar construction. As is well known in the art, operating mechanism 34 includes a stored energy arrangement for closing circuit breaker 30, and a trip mechanism for opening it. For purposes of example, the trip mechanism of operating mechanism 34 is illustrated as having a trip shaft 35 which is rotated clockwise, when viewing FIGS. 1 and 2, to trip circuit breaker 30.

Each pole unit assembly 36 includes an insulative pole base 38 formed of a good electrical insulating material, such as a glass polyester, and upper and lower pole studs 40 and 42 for respective connection to a power source 44 and an electrical load 46. An electrical contact structure 45 includes a relatively stationary electrical contact assembly 47 having a contact head 48 which carries a main contact tip 50. Contact head 48 is mounted for limited pivotal movement on the upper pole stud 40 via a tubular pivot pin 52, and movement limiting means comprising a slot and pin combination 54.

Contact structure 45 also includes a movable electrical contact assembly 55 having a contact arm 56 which is pivotally mounted on the lower pole stud 42 via a pivot pin 58. A contact head 60, which carries a contact tip 62, is fixed to contact arm 56. An insulative drive bar arrangement 64, which includes a drive bar yoke 66 and an elongated drive bar 68, interconnects the movable contact assemblies 55 of the three pole units 36 for simultaneous movement thereof. For simplicity, the complete assembly of three movable contact assemblies 55 and drive bar arrangement 64 will be hereinafter be referred to as movable contact means 70 of circuit breaker 30.

A plurality of insulative links 74 interconnect operating mechanism 34 with drive bar yoke 66, via a pivot pin 76 on yoke 66 and a pivot pin 78 on operating mechanism 34. For purposes of example, a portion of an operating mechanism described in detail in concurrently filed application Ser. No. 07/788,705 is shown in phantom in FIGS. 1 and 2. Operating mechanism 34 includes first and second pivotally joined link members 79 and 80, with the first link member 79 being pivotable about a fixed pivot pin 81, and with the second link member 80 being pivotally linked to the insulative links 74 via the hereinbefore mentioned pivot pin 78. The pivotable joint between link members 79 and 80 includes a roller 82 which is normally held up in a fixed position by a prop link 85. As illustrated in FIG. 1, prop link 85 is normally prevented from rotating to a non-supporting position by trip shaft 35. Operating mechanism 34 may then operate movable contact means 70 between open and closed positions by moving pivot pin 78 up and down, using a pivot axis 89 between link members 79 and 80 as a fixed pivot axis. When trip shaft 35 is rotated clockwise, prop link 85 is free to rotate clockwise due to a force acting upon it by roller 82, and then pivot pin 81 functions as the fixed pivot. The linkage assembly then collapses, allowing the movable contact means 70 to be propelled to the open position shown in FIG. 1. Of course, other operating mechanisms may be used to operate circuit breaker 30.

When circuit breaker 30 is in the closed position shown in FIG. 2, each movable contact assembly 55 applies a force to the associated stationary contact assembly 47, pivoting the stationary contact assembly 47 through the limited movement allowed, biasing a compression spring 83 in each pole unit 36. When operating mechanism 34, or trip shaft 35, trips circuit breaker 30, movable contact means 70 is propelled to the open position shown in FIG. 1, due to forces stored in springs 83, forces stored in other springs (not shown) which are charged when movable contact means 70 moves to the closed position, such as tension springs connected between an insulative portion of the movable contact means 70 and chassis 32, and due to magnetic forces produced when circuit breaker 30 is opened under load.

Chassis 32 includes top and bottom sheet metal members 84 and 86, respectively, a front sheet metal member 88, and first and second upstanding, spaced parallel side sheet metal members, with only a single side member 90 being illustrated in the Figures.

A direct trip actuator 92 constructed according to the teachings of the invention is provided which provides a predetermined mechanical movement to initiate tripping of circuit breaker 30 in response to a trip pulse provided by electrical contrcl 94 associated with circuit breaker 30. As is well known in the art, electrical control 94 monitors the magnitude of the current flowing through circuit breaker 30 and it provides a trip pulse in response to predetermined over-current conditions.

Figure 3:
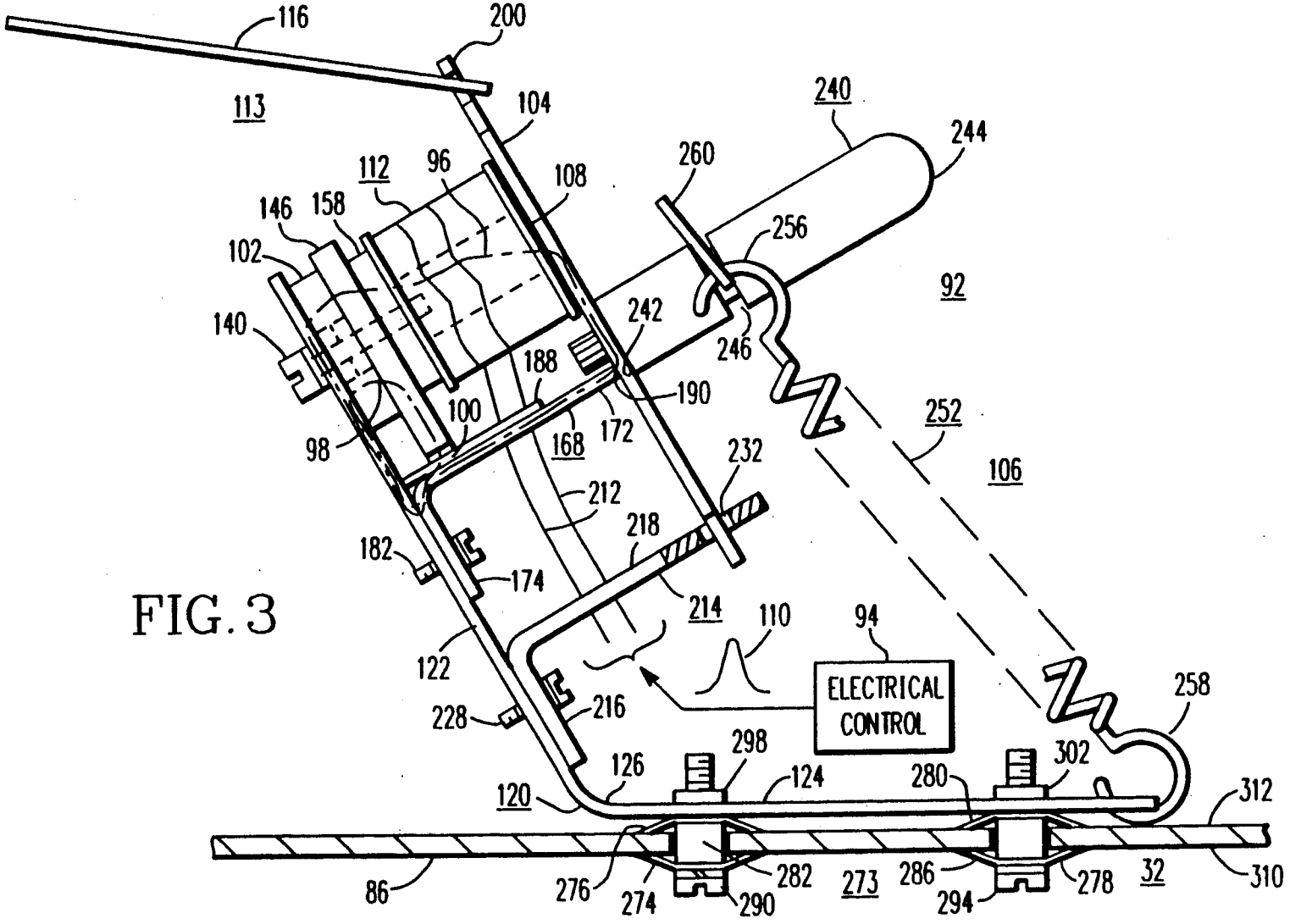
FIG. 3 is an enlarged side elevational view of the trip actuator configuration shown in FIG. 1.
Figure 4:
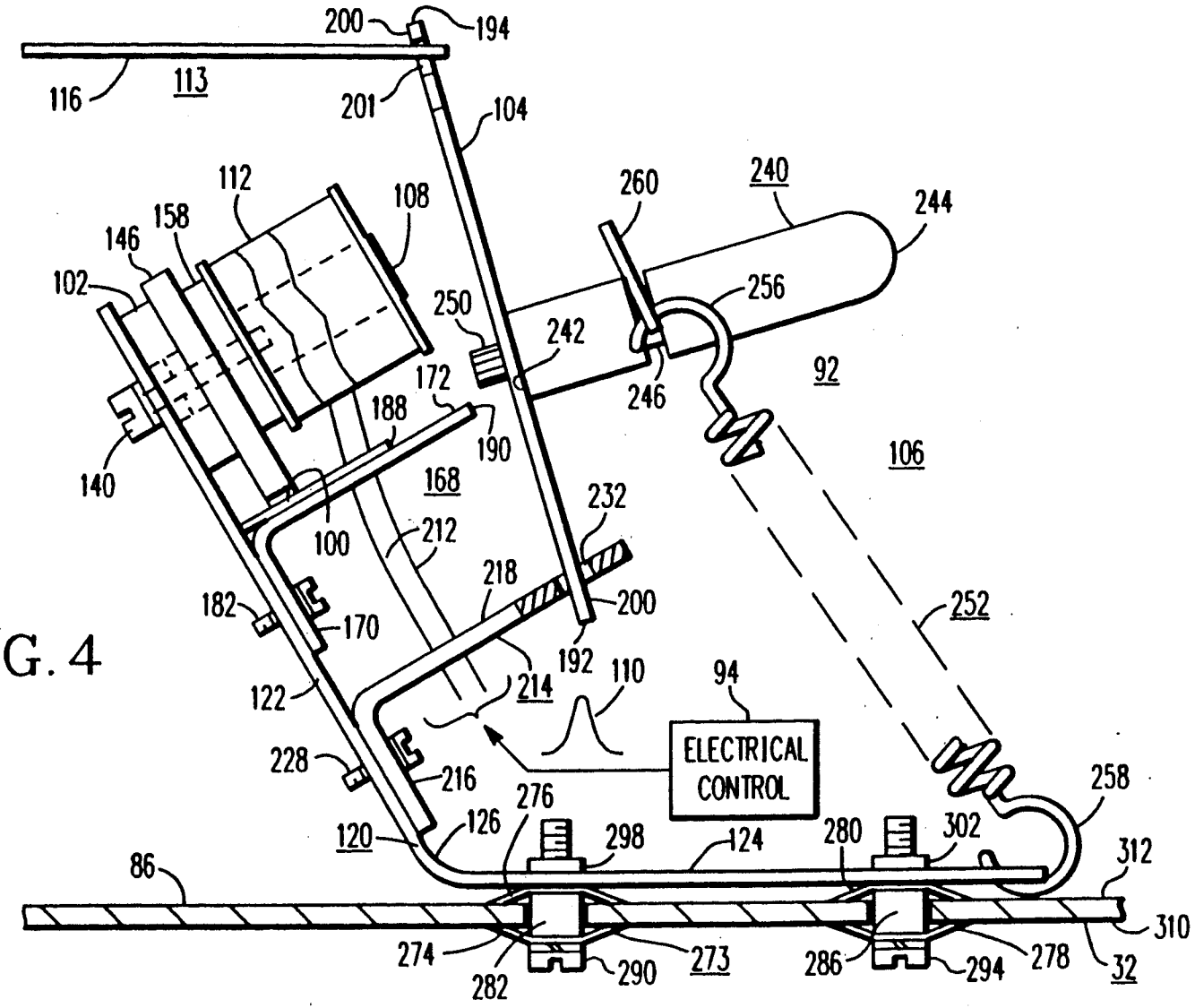
FIG. 4 is an enlarged side elevational view of the trip actuator configuration shown in FIG. 2.
Figure 5:
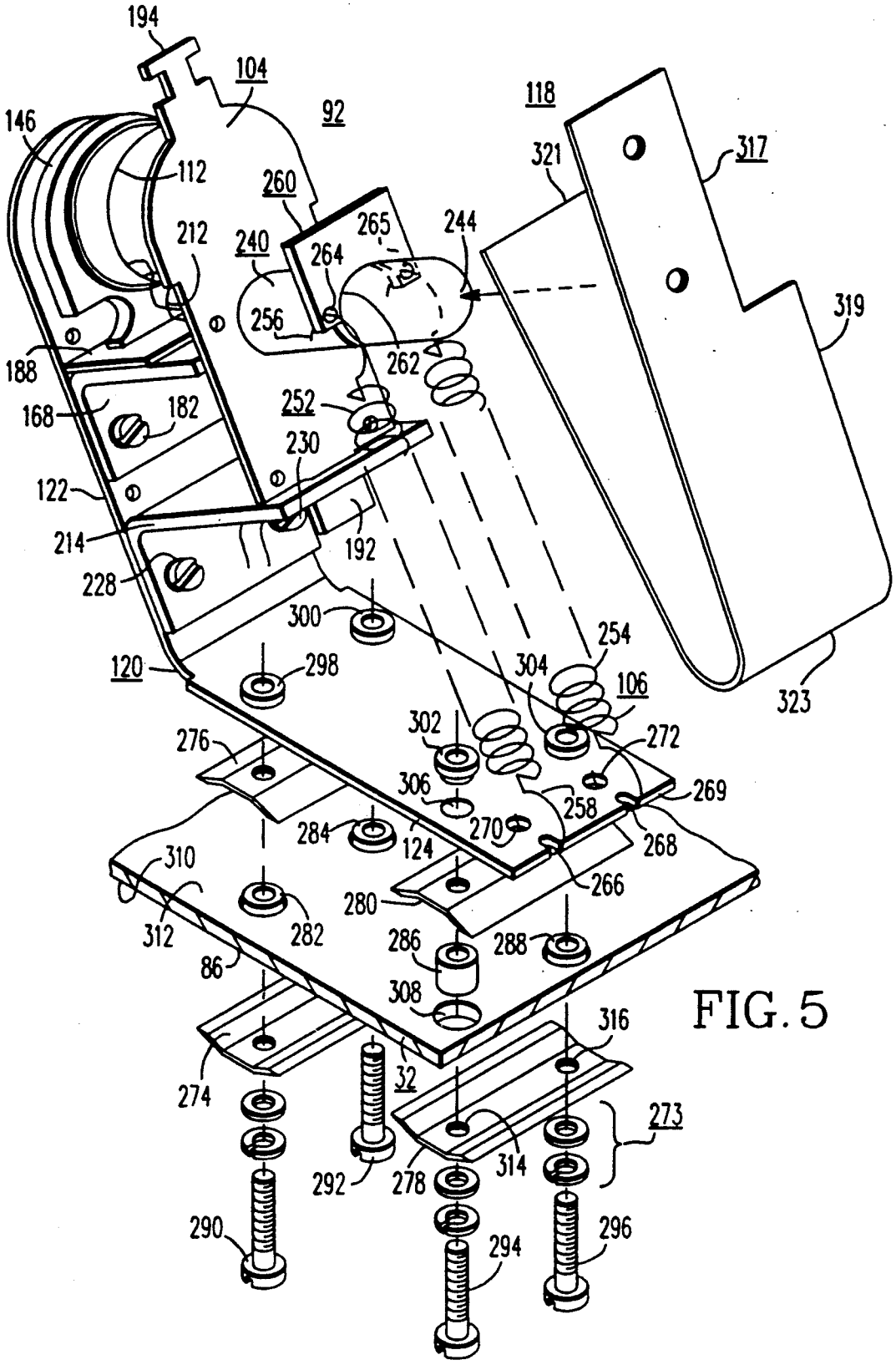
FIG. 5 is a perspective view of the trip actuator shown in FIGS. 1–4, with a shock mounting arrangement shown exploded for clarity.
Figure 6:
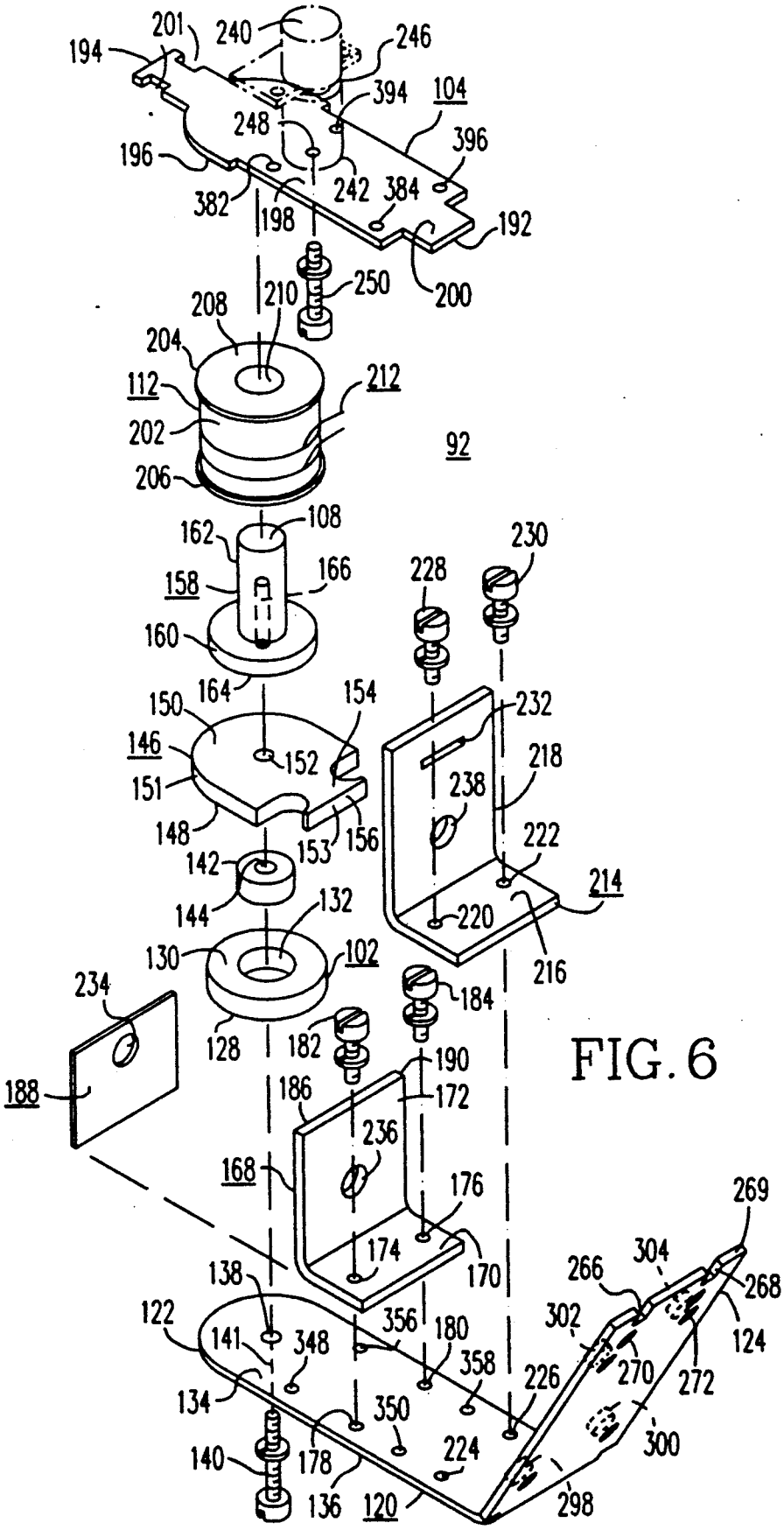
FIG. 6 is an exploded perspective view of the components of the trip actuator which define first and second magnetic circuits.

Referring now to FIGS. 3 and 4, which respectively illustrate the same configurations of direct trip actuator 92 shown in FIGS. 1 and 2, except enlarged, compared with the FIGS. 1 and 2 illustrations, for clarity. The perspective views of trip actuator 92 shown in FIGS. 5 and 6, will also be referred to. FIG. 5 is an exploded view of a preferred shock mounting arrangement for trip actuator 92, and FIG. 6 is an exploded view of an operating portion of trip actuator 92.

As shown in FIG. 3, trip actuator 92 includes first and second magnetic loops, paths or circuits 96 and 98, respectively, set forth with broken lines. The first and second magnetic circuits 96 and 98 are "nested", with the second magnetic circuit 98 being within the loop formed by the first magnetic circuit 96, providing a highly efficient use of the magnetic material which reduces the physical size of the trip actuator 92. A permanent magnet 102 provides magnetic flux for both the first and second magnetic circuits 96 and 98. Although the first magnetic circuit 96 is longer than the second magnetic circuit 98, the reluctance of the first magnetic circuit 96 is lower, and therefore preferred, over the second magnetic circuit 98, because of a non-magnetic gap 100 deliberately provided in the second magnetic circuit 98. A pivotally mounted ferromagnetic clapper member 104 has a first limit position, shown in FIG. 3, in which it is part of the first magnetic circuit 96, and a second limit position, shown in FIG. 4, in which it breaks or opens the first magnetic circuit. Clapper member 104 is biased towards the second limit position by bias means 106. Bias means 106 is selected to provide a biasing force which is less than the magnetic attraction of clapper member 104 to a magnetic pole 108 when they are in contact, and thus the normal or "reset" position for clapper member 104 is that shown in FIG. 3.

An electrical trip pulse 110, provided by electrical control 94 when circuit breaker 30 is to be tripped, is applied to electromagnetic means 112. Electromagnetic means 112 provides a magnetic flux in the first magnetic circuit 96 which momentarily opposes the magnetic flux in the first magnetic circuit 96 provided by permanent magnet 102. Thus, the first magnetic circuit 96 momentarily appears to be a higher reluctance path than the second magnetic circuit 98, and sufficient magnetic flux is immediately transferred to the second magnetic circuit 98 to reduce the attractive force holding clapper member 104 to magnetic pole 108 below the magnitude of the biasing force exerted by bias means 106. Thus, clapper member 104 is immediately pivoted to the second limit position, shown in FIG. 4, before the first magnetic circuit recovers its original flux and magnetic strength at magnetic pole 108.

The transfer of magnetic flux to the second magnetic circuit 98 enables the trip pulse 110 to be of short duration and of low energy level, which would not be case without the convenient second magnetic circuit 98 for the flux from the permanent magnet 102 to switch to and follow. If only the first magnetic circuit 96 were to be provided, the trip pulse 110 would have to have a much longer duration, and a much higher energy level, as the magnetic flux would try to maintain the first magnetic circuit intact. The trip pulse 110 would thus have to produce a high level of counter flux to enable the bias means 106 to break the magnetic attraction between clapper member 1 04 and magnetic pole 108.

Clapper member 104 is linked, via linking means 113, to trip shaft 35. As illustrated in FIGS. 1 and 2, linking means 113 may include an actuating tab 114 mounted on trip shaft 35, and a trip link member 116 which links clapper member 104 with the actuating tab 114. When clapper member 104 is pivoted by bias means 106 to the second limit position shown in FIG. 4, trip link 116 moves along with clapper member 104, to which it is linked, rotating actuating tab 114 and trip shaft 35 in the trip direction, initiating the tripping of circuit breaker 30.

In order to allow clapper member 104 to move a greater distance than actuating tap 114, since trip shaft 35 does not have to rotate many degrees to trip circuit breaker 30, trip link member 116 may be configured such that it moves for a predetermined distance during its initial movement, before it engages tab 114. Tab 114 is then rotated to the trip position shown in FIG. 2, at which time trip shaft 35 is prevented by appropriate stop means from any further clockwise rotation. When trip shaft 35 stops rotating, it also stops clapper member 104 from pivoting any further in the clockwise direction, as viewed in FIGS. 1 and 2. Stopping clapper member 104 before it reaches the end of its pivotal range prevents clapper member 104 from applying bending stresses to its pivotal support.

As the opening circuit breaker 30 propels the movable contact means 70 from the closed position shown in FIG. 2, towards the open position shown in FIG. 1, the movement of the movable contact means 70 is used to immediately reset direct trip actuator 92, via reset means 118 shown in FIGS. 1 and 2. The movement of the movable contact means 70 forces clapper member 104, against the bias of bias means 106, against magnetic pole 108, which again provides a greater holding force than the opening force exerted by bias means 106.

An exemplary embodiment of the invention incorporating the concept of the invention as just set forth, includes a mounting bracket 120, with mounting bracket 120 being constructed of ferromagnetic material, such as plain carbon steel, because in the preferred embodiment of the invention a portion of mounting bracket 120 is used to form a part of both the first and second magnetic circuits 96 and 98. Mounting bracket 120 includes first and second leg portions 122 and 124, respectively, with leg portions 122 and 124 being joined by an intermediate bend portion 126 which establishes a predetermined acute angle between the leg portions, such as an angle of about 120 degrees.

Permanent magnet 102 may be in the form of a cylindrical disc, having first and second magnetic poles 128 and 130, respectively, at the longitudinal ends thereof, and a central opening 132, as best shown in the exploded perspective view of trip actuator 92 in FIG. 6.

The first leg portion 122 of mounting bracket 120 has first and second major, flat, opposed sides or surfaces 134 and 136, respectively. The first magnetic pole 128 of permanent magnet 102 is placed against the first surface 134, axially aligned with an opening 138 in leg portion 122. Opening 138 is sized to slidably receive a screw 140 having a longitudinal axis 141, which axis is also the axis of a first leg of the first magnetic circuit 96.

A non-magnetic centering disc 142 may be disposed within center opening 132 of permanent magnet 102. Disc 142 has an outer diameter sized to snugly enter opening 132, and a center opening 144 sized to slidably receive screw 140.

A ferromagnetic flux transfer plate 146 having first and second major, flat, opposed sides or surfaces 148 and 150, respectively, first and second end portions 151 and 153, and an opening 152, is provided, with the first surface 148 being placed directly upon the second magnetic pole 130 of permanent magnet 102 such that opening 152 is aligned with longitudinal axis 141. Flux transfer plate 146 includes an integral extension or leg portion 154 at the second end portion 153 having a flat end surface 156 which functions to provide one side of the hereinbefore mentioned non-magnetic gap 100 in the second magnetic circuit 98.

The first magnetic circuit 96 is continued with an elongated, cylindrical, ferromagnetic post member 158. Post member 158 includes a cylindrical base portion 160 having a first diameter, an integral upstanding cylindrical portion 162 having a second diameter, which is less than the first diameter, and a first flat longitudinal end surface 164 on the base portion 160. A second flat longitudinal end surface is provided at the termination of cylindrical portion 162, and it is referenced 108, since it functions as the hereinbefore mentioned magnetic pole 108.

The first end surface 164 of base portion 160 is placed in contact with the second surface 150 of flux transfer plate 146, with post member 158 having a blind tapped opening 166 which extends longitudinally inward from end surface 164. Opening 166 is dimensioned to threadably receive screw 140.

Screw 140, which may be formed of non-magnetic material, such as brass, is thus used to firmly hold together an assembly which includes leg portion 122 of mounting bracket 120, permanent magnet 102, flux transfer plate 146, and cylindrical post member 158.

A ferromagnetic right angle member 168 is provided which has first and second leg portions 170 and 172. The first leg portion 170 includes a pair of openings 174 and 176, and the first leg portion 122 of mounting bracket 120 includes a pair of tapped openings 178 and 180. Screws 182 and 184 firmly attach the first leg portion 170 to the first surface 134 of leg portion 122. Right angle member 168 is positioned on leg portion 122 such that the second leg portion 172 is spaced a predetermined dimension from end surface 156 of leg 154 of flux transfer plate 146, and thus the flat surface 186 of the second leg portion 172 which faces end surface 156 establishes the other side of non-magnetic gap 100. The second leg portion 172 of right angle member 168 has a length dimension selected such that end surface 190 contacts clapper member 104 when clapper member 104 is in the first limit position, i.e., part of the first magnetic circuit 96. Thus, end surface 190 functions as a magnetic pole, similar to the function of end surface 108, although much weaker.

In order to keep debris out of non-magnetic gap 100, a thin non-magnetic plate member 188, which may be formed of plastic, for example, is provided. Plate member 188 has a thickness dimension selected to enable it to be snugly but slidably inserted into the non-magnetic gap 100.

Clapper member 104, which is formed of a ferromagnetic material, is an elongated member having first and second ends 192 and 194, respectively, and first and second major, flat, opposed surfaces 196 and 198, respectively. The first end 192 is narrowed to define a tab 200 which forms part of a pivotable mounting structure of clapper member 104. The second end 194 has an H-shaped configuration, defining indentations 201 which slidably secure trip link 116. Trip link 116 may be in the form of a wire loop, for example.

Electromagnetic means 112 is in the form of an electromagnetic coil 202 wound on a bobbin 204 having first and second longitudinal ends 206 and 208, respectively, an opening 210 which extends between its ends, and electrical leads 212. Opening 208 is dimensioned to snugly but slidably enable electromagnetic coil 202 to be positioned on the cylindrical portion 162 of post member 158. Electromagnetic coil 212 is wound to convert the polarity of the electrical trip pulse 110 to a magnetic flux in the first magnetic circuit 96 which opposes the magnetic flux provided in the first magnetic circuit by permanent magnet 102.

The pivotable mounting arrangement of clapper member 104 is completed by a non-magnetic support member in the form of a right angle member 214 having first and second leg portions 216 and 218, respectively. The first leg portion 216 has a pair of openings 220 and 222, and the first leg portion 216 is disposed against surface 134 of the first leg portion 122 of mounting bracket 120 with openings 220 and 222 respectively aligned with a pair of tapped openings 224 and 226 in leg portion 122. Screws 228 and 230 secure right angle member 214 firmly to mounting bracket 120.

The second leg portion 218 of non-magnetic right angle member 214 includes an elongated opening or slot 232 having an elongated length dimensioned to snugly but slidably receive the width dimension of tab 192 of clapper member 104. Slot 232 has a height dimension which exceeds the thickness dimension of tab 200, with the height dimension being selected to allow clapper member 104 to be solidly in contact with poles 108 and 190, as shown in FIG. 3, without either the upper surface or the lower surface which cooperatively define the height dimension of slot 232. This assures that clapper member 104 will complete the first magnetic circuit 96 without contacting gaps between the pole surfaces and clapper member 104. The selected height dimension of slot 232 will inherently provide more than the desired amount of mechanical movement of clapper member 104 necessary to pivot it the second limit position, to assure tripping of circuit breaker 30.

In order to protect electrical leads 212, openings 234, 236 and 238 are respectively provided in spacer member 188, and in leg portions 172 and 218 of right angle members 168 and 214. Openings 234, 236 and 238 are aligned on a common axis, and electrical leads 212 from electromagnetic coil 202 are threaded therethrough, as illustrated in FIGS. 3 and 4. This arrangement in the handling of electrical leads 212, in addition to keeping electrical leads 212 away from the movable portions of trip actuator 92, provides the additional function of preventing spacer member 188 from sliding out of the non-magnetic gap 100.

In order to protect ferromagnetic members 120, 146, 158, 104 and 168 from corrosion, they are preferably plated with a thin non-magnetic metallic coating, such as a non-magnetic coating of 0.0003 to 0.0005 inch (0.008–0.013 mm). The plated coatings provide ten small non-magnetic gaps in the first magnetic circuit 96. In order to enable normal plating thickness tolerances to be used, substantially lowering the cost of the plating operation, the non-magnetic gap 100 in the second magnetic circuit 98 is selected to exceed the maximum cumulative non-magnetic gap in the first magnetic circuit 96 caused by the plated ferromagnetic components. For example, the maximum plating thickness using normal plating tolerances is about 0.001 inch (0.025 mm), which when multiplied by ten provides a maximum non-magnetic gap of 0.010 inch (0.25 mm)in the first magnetic circuit 96. Thus, the non-magnetic gap 100 in the second magnetic circuit 98 may be about 0.063 inch (1.60 mm), for example, which is six times greater than the largest possible sum of the ten plating gaps.

The bias means 106 which urges clapper member 104 towards the second limit position shown in FIGS. 2 and 4 includes an insulative post member 240 having first and second ends 242 and 244, respectively, and a circumferential groove 246. The first end 242, which has a longitudinally extending tapped opening, is placed against surface 198 of clapper member 104, aligned with an opening 248 in clapper member 104. A screw 250 firmly attaches post member 240 to clapper member 104.

As best shown in FIG. 5, bias means 106 further includes first and second tension springs 252 and 254 each having first and second ends 256 and 258. A yoke member 260 is provided which has curved indentation 262 extending inwardly from one side thereof, and with an opening being provided on each side of indentation 262, such as openings 264 and 265. The second leg portion 124 of mounting bracket 120 has first and second notches 266 and 268 formed in an extreme end 269 thereof, and first and second openings 270 and 272 are provided which are respectively spaced inwardly by a small dimension from notches 266 and 268.

The first ends 256 of tension springs 252 and 254 are respectively threaded through the spaced openings 264 and 265 of yoke member 260, and yoke member 260 is positioned in circumferential groove 246 of post member 240, with curved surface 262 entering groove 246. Tension springs 252 and 254 are then extended such that the second end 258 of each engages a notch and enters an associated opening of the second leg portion 124 of mounting bracket 120, i.e., the second end 258 of tension spring 252 engages notch 266 and enters opening 270, and the second end of tension spring 254 engages notch 268 and enters opening 272. The tensioned springs 252 and 254 hold yoke member 260 firmly in circumferential groove 246 of post member 240.

It is important that mechanical shock created when circuit breaker 30 closes does not accidentally trigger trip actuator 92, causing clapper member 104 to pivot from the first to the second limit position. To prevent mechanical shock from triggering trip actuator 92, the second leg portion 124 of mounting bracket 120 is shock mounted to chassis 32, such as to the bottom metallic sheet 86, via shock mounting means 273. As shown in FIGS. 3 and 4, and in an exploded view in FIG. 5, the shock mounting means 273, in a preferred embodiment thereof, includes four leaf springs 274, 276, 278 and 280, each bent with two spaced, parallel bend lines to form a concave side, four non-threaded spacer members 282, 284, 286 and 288, four screws 290, 292, 294 and 296, and four threaded insert members 298, 300, 302 and 304.

The four threaded insert members 298, 300, 302 and 304 are securely fixed, such as with press fits, in four openings disposed in the second leg portion 124 of mounting bracket 120, e.g., insert member 302 is fixed in an opening 306 shown in FIG. 5. The four spacer members 282, 284, 286 and 288 are disposed in relative large openings in bottom sheet member 86 of chassis 32, e.g., spacer member 286 is disposed in an opening 308, with opening 308 having a larger diameter than the diameter of spacer member 286, to allow free movement of spacer member 286 perpendicular to the plane of the bottom sheet member 86. The concave sides of leaf springs 274 and 278 are placed facing a lower surface 310 of bottom sheet member 86, and the concave sides of leaf spring members 276 and 280 are placed facing an upper surface 312 of bottom sheet member 86. Spacer members 282, 284, 286 and 288 are disposed to space the central portions of the upper and lower leaf springs of each pair. Each leaf spring member has a pair of spaced openings, such as openings 314 and 316 in leaf spring member 278, and openings 314 and 316 are aligned with associated openings in non-threaded insert members 282, 284, 286 and 288, as well as with associated openings in threaded insert members 298, 300, 302 and 304. Screws 290, 292, 294, and 296 are then inserted through the aligned openings and threadably engaged with the tapped openings in insert members 298, 300, 302 and 304, to firmly but resiliently mount trip actuator 92 to chassis 32. The outer edges of the downwardly bent portions of the leaf springs contact the upper and lower surfaces 312 and 310 of chassis bottom 86, and the fixedly spaced central portions of the leaf springs are free to move up and down together to provide the desired resilient mounting of the trip actuator 92.

Reset means 118, in a preferred embodiment of the invention, as set forth in FIGS. 1 and 2, and in phantom in FIG. 5, includes a leaf spring 317 having first and second leg portions 319 and 321, respectively. Leg portions 319 and 321 are joined by a curved bend portion 323 which forms a predetermined angle between leg portions 319 and 321, such as an unstressed angle of about 20 degrees. The first leg portion 319 is fixed to a suitable portion of movable contact means 70, such as to drive bar 68. The second leg portion 321 is positioned to resiliently contact end 244 of post member 240 as movable contact means 70 pivots to the open position thereof. The second leg portion 321 contacts end 244 of insulative post member 240, pivoting clapper member 104 back to the reset position with a firm but resilient force which overcomes the opposing force exerted by bias 106. The leaf spring member 317, which has relatively wide leg portions 319 and 321, as shown in FIG. 5, in addition to providing a non-shock resetting force, considerably relaxes the tolerances in the relative positioning of trip actuator 92 and the movable contact means 70. Post member 240, being formed of an electrical insulative material, prevents any short circuits to ground through the reset means 118 when an arc and plasma are formed between the contacts of circuit breaker 30 when it is operated to the open position.

Figure 7:
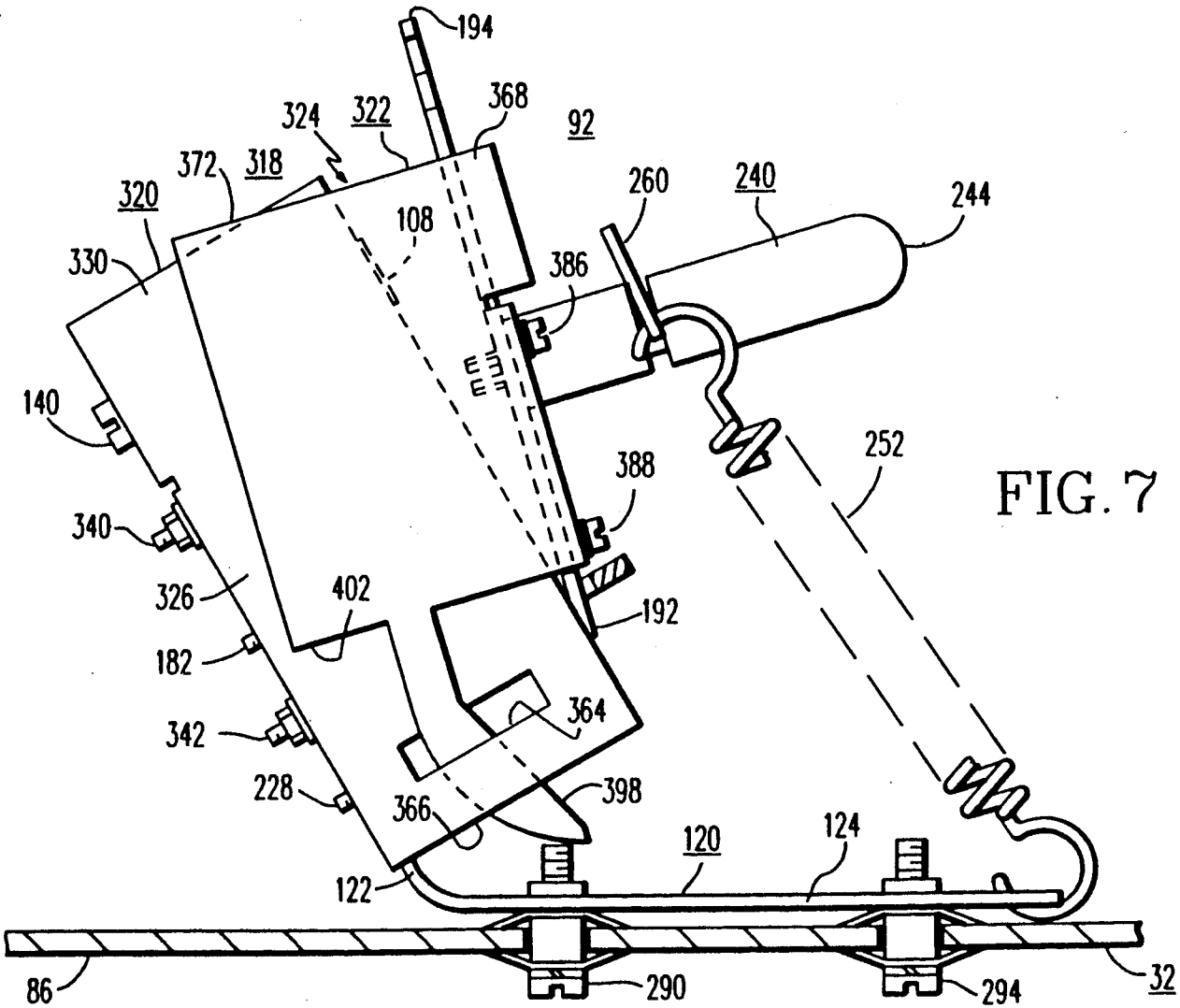
FIG. 7 is a side elevational view of the trip actuator, similar to FIG. 4, except with a housing having first and second co-operable housing members constructed according to the teachings of the invention.

In order to prevent dirt and debris, especially ferromagnetic debris, from entering trip actuator 92, a clam shell type housing 318 is provided for trip actuator 92, as shown in FIG. 7. Housing 318 is formed of first and second co-operable housing members 320 and 322 shown in perspective in FIGS. 8 and 9, respectively. Housing members 320 and 322, which may be formed of a paper fiber material, a strong durable plastic material, or of a non-magnetic metal, such as aluminum, are respectively fixed to stationary and movable portions of trip actuator 92, e.g., to leg portion 122 of mounting bracket 120, and to the clapper member 104.

When trip actuator 92 is in the reset position shown in FIG. 3, housing members 320 and 322 nest with a small clearance between them, such as a clearance of about 0.03 inch (0.8 mm). When trip actuator 92 is in the actuated position shown in FIGS. 4 and and 7, the housing member 322 on the pivotable clapper member 104 opens housing 318 slightly to momentarily provide a small opening 324 to the inside of the housing 318. Opening 324 exists only for the length of time required to pivot clapper member 104 to the actuated position, and for the opening circuit breaker 30 to immediately reset it.

Also, it will be noted in FIG. 7, that when housing member 322 is in the "open" position, that it still protects the inside of housing 318 from any dirt or debris that may fall under the influence of gravity, with a front portion thereof pivoting into a substantially horizontal orientation that forms a temporary cover.

Figure 8:
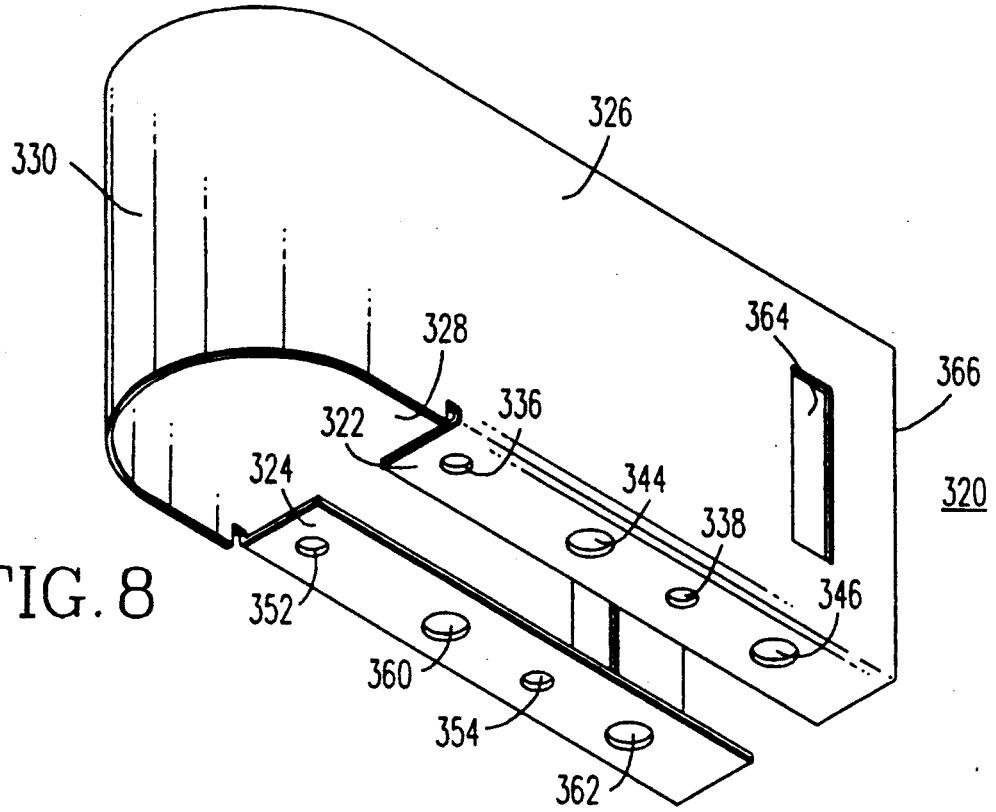
FIG. 8 is a perspective view of the housing member shown in FIG. 7 which surrounds a fixed portion of the trip actuator.

The first housing member 320, best shown in FIG. 8, includes first and second upstanding side wall portions 326 and 328, respectively, which are joined by a curved front portion 330. Front portion 330 closely conforms to the curved portions of bracket leg 122 and flux transfer plate 146. A back portion is not required, as the second leg portion 218 of non-magnetic right angle member 214 functions as a back portion of the stationary part of housing 318. A closed bottom portion is also not necessary, as the second leg portion 122 of mounting bracket 120 functions as a bottom portion of the stationary part of housing 318.

Housing member 320 does have a partial bottom portion comprising first and second inwardly bent tabs 332 and 334 which function as mounting tabs for fixing housing member 320 to the second leg portion 122 of mounting bracket 120. For example, tab 322 has openings 336 and 338 which respectively receive mounting screws 340 and 344, as shown in FIG. 7. Tab 322 has additional openings 344 and 346 for allowing screws 182 and 228 to extend therethrough. Mounting screws 340 and 342 extend through openings 348 and 350 in leg portion 122 of mounting bracket 120, with openings 348 and 350 being shown in FIG. 6.

In like manner, the second mounting tab 324 has openings 352 and 354 which cooperate with openings 356 and 358 in bracket leg portion 122, and with mounting screws similar to mounting screws 340 and 342, for securing tab 324. Openings 360 and 362 allow screws 184 and 230 to extend therethrough.

The first and second side walls 326 and 328 and front portion 330 define an opening at the top of the housing member 320 which allows clapper member 104 to pivot freely between its limit positions. The first and second side walls 326 and 328 each have similar elongated slots formed therein near their vertical back edges, such as slot 364 formed near back edge 366 of the first side wall portion 326.

Figure 9:
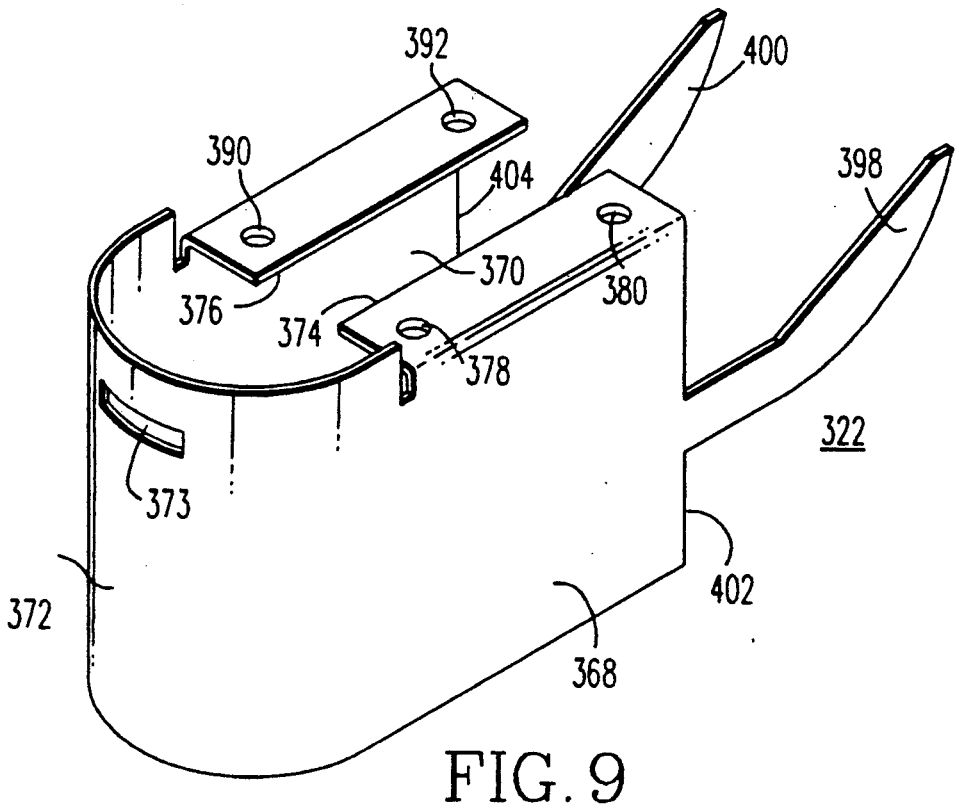
FIG. 9 is a perspective view of the housing member shown in FIG. 7 which surrounds a movable portion of the trip actuator, and which cooperates with the housing member shown in FIG. 8 to completely enclose the trip actuator when the trip actuator is in the reset position.

The second housing member 322, best shown in FIG. 9, includes first and second depending side wall portions 368 and 370, respectively, which are joined by a curved front portion 372. Front portion 372 closely conforms to the curved portion of clapper member 104, and it has an elongated slot 373 through which the H-shaped end 194 of clapper member 104 extends. A back portion is not required, as the second leg portion 218 of non-magnetic right angle member 214 functions as a back portion of both the stationary and movable parts of housing 318. A top portion is also not necessary, as clapper member 104 functions as a top portion of the movable part of housing 318. Housing member 322 does have a partial top portion comprising first and second inwardly bent tabs 374 and 376 which function as mounting tabs for fixing housing member 322 to clapper member 104. For example, tab 374 has openings 378 and 380 which cooperate with openings 382 and 384 in clapper member 104 in receiving mounting screws 386 and 388, such as shown in FIG. 7.

In like manner, the second mounting tab 376 has openings 390 and 392 which cooperate with openings 394 and 396 in clapper member 104, and with mounting screws similar to mounting screws 386 and 388, for securing tab 376.

The first and second side walls 368 and 370 and front portion 372 define an opening at the bottom of housing member 322 which allows housing member 322 to move in closely adjacent relation relative to housing member 320 as clapper member 104 pivots between its limit positions.

The first and second side walls 368 and 370 have tab members 398 and 400 which extend outwardly from their vertically extending back edges 402 and 404. Tab members 398 and 400 extend through the elongated slots formed in the side wall portions 326 and 328 of the first housing member 320, e.g., tab member 398 extends through slot 364, as illustrated in FIG. 7. The cooperative tab members and slots assure that the respective side wall portions of the first and second housing members 320 and 322 remain in close proximity during the pivoting of the second housing member 322 throughout the operating life of circuit breaker 30.

In summary, there has been disclosed a circuit breaker 30 having a new and improved direct trip actuator 92 which eliminates the rectilinear movement of a prior art trip actuator of which we are aware, with trip actuator 92 utilizing a reliable pivotable movement to provide the desired mechanical movement which initiates tripping of circuit breaker 30. The manufacturing cost of trip actuator 92 is about ⅓ of the manufacturing cost of the rectilinear prior art type, and the reliability of the pivotable direct trip actuator 92 is as good or better than a direct trip actuator constructed with guided rectilinear components.

We claim:

1. A circuit breaker having electrical contacts operable between open and closed positions, including a movable contact assembly which is pivoted to an open position when the electrical contacts are operated to the open position, and a trip actuator which provides a mechanical movement upon receiving an electrical trip pulse, with the mechanical movement actuating a trip mechanism of the circuit breaker to cause the electrical contacts to assume the open position, with the trip actuator being characterized by:

first and second parallel magnetic circuits, said first magnetic circuit having a lower reluctance than said second magnetic circuit, magnet means disposed to provide magnetic flux for both said first and second magnetic circuits, with the flux from said magnet means favoring the lower reluctance of the first magnetic circuit, a pivotally mounted clapper member having a first position in which it is releasably held in said first magnetic circuit by a magnetic force, and a second position which opens said first magnetic circuit, bias means providing a biasing force which biases said clapper member toward said second position, with the bias means being selected to provide a biasing force which is less than said magnetic force holding the clapper member in said first position, electromagnetic means for receiving the electrical trip pulse, with the trip pulse causing said electromagnetic means to provide a magnetic flux which momentarily opposes the magnetic flux in said first magnetic circuit, switching the magnetic flux provided by the magnet means to the second magnetic circuit and reducing the magnetic force holding the clapper member in said first position below the magnitude of the biasing force, whereby said bias means pivots the clapper member to said second position, linking means disposed between the clapper member and the trip mechanism of the circuit breaker, with the pivoting of the clapper member to said second position actuating the trip mechanism, and including reset means fixed to the pivotable movable contact assembly which contacts and resets the pivotable clapper member to the first position thereof in response to the pivotable movement of the movable contact assembly to the open position.

2. A circuit breaker having electrical contacts operable between open and closed positions, including a movable contact assembly which is pivoted to a open position when the electrical contacts are operated to the open position, and a trip actuator which provides a mechanical movement upon receiving an electrical trip pulse, with the mechanical movement actuating a trip mechanism of the circuit breaker to cause the electrical contacts to assume the open position, with the trip actuator being characterized by:

first and second parallel magnetic circuits, said first magnetic circuit having a lower reluctance than said second magnetic circuit, magnet means disposed to provide magnetic flux for both said first and second magnetic circuits, with the flux from said magnet means favoring the lower reluctance of the first magnetic circuit, a pivotally mounted clapper member having a first position in which i is releasably held in said first magnetic circuit by a magnetic force, and a second position which opens said first magnetic circuit, bias means providing a biasing force which biases said clapper member toward said second position, with the bias means being selected to provide a biasing force which is less than said magnetic force holding the clapper member in said first position, electromagnetic means for receiving the electrical trip pulse, with the trip pulse causing said electromagnetic means to provide a magnetic flux which momentarily opposes the magnetic flux in said first magnetic circuit, switching the magnetic flux provided by the magnet means to the second magnetic circuit and reducing the magnetic force holding the clapper member in said first position below the magnitude of the biasing force, whereby said bias means pivots the clapper member to said second position, linking means disposed between the clapper member and the trip mechanism of the circuit breaker, with the pivoting of the clapper member to said second position actuating the trip mechanism, and reset means which resets the clapper member to the first position thereof in response to the movement of the movable contact assembly to the open position, said reset means including a leaf spring member fixed to the movable contact assembly, and a post member having a first end fixed to the clapper member and a second end, said leaf spring member contacting the second end of said post member during the movement of the movable contact assembly to the open position thereof to force the clapper member from the second position to the first position thereof.

3. The circuit breaker of claim 2 wherein the post member includes a circumferential groove disposed intermediate the first and second ends thereof, the trip actuator includes a mounting bracket, and the bias means includes tension spring means and a yoke member, with the tension spring means linking said yoke member to said mounting bracket, and wherein the yoke member is disposed in the circumferential groove of the post member and maintained therein by biasing forces provided by the tension spring means.

4. The circuit breaker of claim 1 wherein the circuit breaker includes a chassis, and the trip actuator includes a mounting bracket, and means for chock mounting the mounting bracket to said chassis.

5. A circuit breaker having a chassis, electrical contacts operable between open and closed positions, and a trip actuator which provides a mechanical movement upon receiving an electrical trip pulse, with the mechanical movement actuating a trip mechanism of the circuit breaker to cause the electrical contacts to assume the open position, with the trip actuator being characterized by:

first and second parallel magnetic circuits, said first magnetic circuit having a lower reluctance than said second magnetic circuit, magnet means disposed to provide magnetic flux for both said first and second magnetic circuits, with the flux from said magnet means favoring the lower reluctance of the first magnetic circuit, a pivotally mounted clapper member having a first position in which i is releasably held in said first magnetic circuit by a magnetic force, and a second position which opens said fist magnetic circuit, bias means providing a biasing force which biases said clapper member toward said second position, with the bias means being selected to provide a biasing force which is less than said magnetic force holding the clapper member in said first position, electromagnetic means for receiving the electrical trip pulse, with the trip pulse causing said electromagnetic means to provide a magnetic flux which momentarily opposes the magnetic flux in said first magnetic circuit, switching the magnetic flux provided by the magnet means to the second magnetic circuit and reducing the magnetic force holding the clapper member in said first position below the magnitude of the biasing force, whereby said bias means pivots the clapper member to said second position, linking means disposed between the clapper member and the trip mechanism of the circuit breaker, with the pivoting of the clapper member to said second position actuating the trip mechanism, a mounting bracket for the trip actuator, and means for shock mounting said mounting bracket to the chassis, said means for shock mounting the mounting bracket to the chassis including at least first and second pairs of leaf spring members, with leaf spring members of each pair contacting opposite sides of a chassis member.

6. A circuit breaker having a chassis and electrical contacts operable between open and closed positions, and a trip actuator which provides a mechanical movement upon receiving an electrical trip pulse, with the mechanical movement actuating a trip mechanism of the circuit breaker to cause the electrical contacts to assume the open position, with the trip actuator being characterized by:

first and second parallel magnetic circuits, said first magnetic circuit having a lower reluctance than said second magnetic circuit, magnet means disposed to provide magnetic flux for both said first and second magnetic circuits, with the flux from said magnet means favoring the lower reluctance of the first magnetic circuit, a pivotally mounted clapper member having a first position in which i is releasably held in said first magnetic circuit by a magnetic force, and a second position which opens said first magnetic circuit, bias means providing a biasing force which biases said clapper member toward said second position, with the bias means being selected to provide a biasing force which is less than said magnetic force holding the clapper member in said first position, electromagnetic means for receiving the electrical trip pulse, with the trip pulse causing said electromagnetic means to provide a magnetic flux which momentarily opposes the magnetic flux in said first magnetic circuit, switching the magnetic flux provided by the magnet means to the second magnetic circuit and reducing the magnetic force holding the clapper member in aid first position below the magnitude of the biasing force, whereby said bias means pivots the clapper member to said second position, linking means disposed between the clapper member and the trip mechanism of the circuit breaker, with the pivoting of the clapper member to said second position actuating the trip mechanism, a mounting bracket for the trip actuator, means for chock mounting the mounting bracket to the chassis, said chassis including a bottom sheet member having upper and lower sides, said means for chock mounting the mounting bracket to the chassis including a plurality of leaf spring members, a plurality of mounting screws, and a plurality of spacer members, said mounting screws attaching the mounting bracket to the upper side of said bottom sheet member while positioning the plurality of leaf spring members, with the plurality of leaf spring members being disposed in pairs, with one leaf spring member of each pair being disposed between said mounting bracket and the upper side of the bottom sheet member, and the remaining leaf spring member of each pair being disposed between the lower side of the bottom sheet member and a head portion of a mounting screw, one of said spacer members being disposed about each mounting screw, with the spacer member spacing the leaf spring members of each pair, and wherein the bottom sheet member includes an opening dimensioned to receive each spacer member and to allow the spacer member to move relative to the bottom sheet member in response to movement of the associated leaf spring members.

7. The circuit breaker of claim 1 wherein the magnet means includes a permanent magnet, and the electromagnetic means includes an electromagnetic coil.

8. The circuit breaker of claim 1 wherein the first and second parallel magnetic circuits are nested, one within the other, with the second magnetic circuit defining a permanent closed loop which is disposed within an openable loop defined by the first magnetic circuit.

9. The circuit breaker of claim 1 including means providing a non-magnetic gap in the second magnetic circuit having a predetermined gap dimension, and wherein the first magnetic circuit includes a plurality of assembled magnetic members plated with non-magnetic material, with said predetermined dimension of said non-magnetic gap being selected to exceed the cumulative gap created in the first magnetic circuit provided by said non-magnetic plating material.

10. The circuit breaker of claim 1 wherein the circuit breaker includes a chassis, and the trip actuator includes a mounting bracket which mounts the trip actuator to said chassis, with a portion of said mounting bracket forming a part of the first and second magnetic circuits.

11. A circuit breaker having electrical contacts operable between open and closed positions, and a rip actuator which provides a mechanical movement upon receiving an electrical trip pulse, with the mechanical movement actuating a trip mechanism of the circuit breaker to cause the electrical contacts to assume the open position, with the trip actuator being characterized by:

first and second parallel magnetic circuits, said first magnetic circuit having a lower reluctance than said second magnetic circuit, magnet means disposed to provide magnetic flux for both said first and second magnetic circuits, with the flux from said magnet means favoring the lower reluctance of the first magnetic circuit, a pivotally mounted clapper member having a first position in which i is releasably held in said first magnetic circuit by a magnetic force, and a second position which opens said fist magnetic circuit, bias means providing a biasing force which biases said clapper member toward said second position, with the bias means being selected to provide a biasing force which is less than said magnetic force holding the clapper member in said first position, electromagnetic means for receiving the electrical trip pulse, with the trip pulse causing said electromagnetic means to provide a magnetic flux which momentarily opposes the magnetic flux in said first magnetic circuit, switching the magnetic flux provided by the magnet means to the second magnetic circuit and reducing the magnetic force holding the clapper member in said first position below the magnitude of the biasing force, whereby said bias means pivots the clapper member to said second position, linking means disposed between the clapper member and the trip mechanism of the circuit breaker, with the pivoting of the clapper member to said second position actuating the trip mechanism, said magnetic means including a permanent magnet having first and second magnetic poles, said clapper member having first and second ends, a ferromagnetic mounting bracket for the trip actuator, said mounting bracket having first and second leg portions, the first magnetic pole of said permanent magnet being disposed on the first leg portion of said mounting bracket, a ferromagnetic flux transfer plate having first and second end portions and first and second major, flat opposed surfaces, said flux transfer plate having a portion of the first flat surface which is adjacent to said first end portion disposed against the second magnetic pole of the permanent magnet, a ferromagnetic elongated post member having first and second ends, with the first end of the elongated post member being disposed against a portion of the second flat surface of the flux transfer plate which is adjacent to the first end portion thereof, with the electromagnetic means being disposed in inductive relation with said elongated post member, a non-magnetic right angle member having a first leg portion fixed to the first leg portion of the mounting bracket, and a second leg portion which extends outwardly from the first leg portion of the mounting bracket in predetermined spaced parallel relation with the elongated post member, with the first end of the clapper member being pivotally mounted to the second leg portion of the non-magnetic right angle member, and with the clapper member, near the second end thereof, being magnetically attracted to the second end of the elongated post member, a ferromagnetic right angle member having a first leg portion fixed to the first leg portion of the mounting bracket, and a second leg portion which extends outwardly from the first leg portion of the mounting racket, between and in spaced parallel relation with the elongated post member and the second leg portion of the non-magnetic right angle member, with the second end of the flux transfer plate being spaced from the second leg portion of the ferromagnetic right angle member to define a non-magnetic gap having a predetermined gap dimension, and wherein a predetermined surface of the second leg portion of the ferromagnetic right angle member butts against the clapper member when the clapper member is in the first position thereof, with the first magnetic circuit including, when the clapper member is in the first position thereof, the first leg portion of said mounting bracket, said permanent magnet, said flux transfer plate, said elongated post member, the clapper member, and the ferromagnetic right angle member, and with the second magnetic circuit including the first leg portion of said mounting bracket, said permanent magnet, said flux transfer plate, said non-magnetic gap, and a portion of said ferromagnetic right angle member.

12. The circuit breaker of claim 11 including a non-magnetic spacer member snugly disposed in the non-magnetic gap.

13. The circuit breaker of claim 12 wherein the electromagnetic means includes an electrical coil having electrical leads, and the non-magnetic spacer member and second leg portion of the ferromagnetic right angle member define aligned openings, with said electrical leads extending through said aligned openings.

14. The circuit breaker of claim 13 wherein the electrical leads prevent the non-magnetic spacer member from moving out of the gap between the second end of the flux transfer plate and the second leg portion of the ferromagnetic right angle member.

15. A circuit breaker having a chassis and electrical contacts operable between open and closed positions, and a trip actuator which provides a mechanical movement upon receiving an electrical trip pulse, with the mechanical movement actuating a trip mechanism of the circuit breaker to cause the electrical contacts to assume the open position, with the trip actuator being characterized by:

first and second parallel magnetic circuits, said first magnetic circuit having a lower reluctance than said second magnetic circuit, magnet means disposed to provide magnetic flux for both said first and second magnetic circuits, with the flux from said magnet means favoring the lower reluctance of the first magnetic circuit, a pivotally mounted clapper member having a first position in which i is releasably held in said first magnetic circuit by a magnetic force, and a second position which opens said fist magnetic circuit, bias means providing a biasing force which biases said clapper member toward said second position, with the bias means being selected to provide a biasing force which is less than said magnetic force holding the clapper member in said first position, electromagnetic means for receiving the electrical trip pulse, with the trip pulse causing said electromagnetic means to provide a magnetic flux which momentarily opposes the magnetic flux in said first magnetic circuit, switching the magnetic flux provided by the magnet means to the second magnetic circuit and reducing the magnetic force holding the clapper member in said first position below the magnitude of the biasing force, whereby said bias means pivots the clapper member to said second position, linking means disposed between the clapper member and the trip mechanism of the circuit breaker, with the pivoting of the clapper member to said second position actuating the trip mechanism, a mounting bracket for said trip actuator, said mounting bracket having a first leg portion which supports components of the trip actuator, and a second leg portion which mounts the trip actuator to said chassis, and including a clam-shell housing having first and second co-operable housing members respectively fixed to the first leg portion of the mounting bracket and to the clapper member, with said housing members completely enclosing the trip actuator when the clapper member is in the first position thereof, and partially enclosing the trip actuator when the clapper member is in the second position thereof, with said second housing member being positioned during said partial enclosure to shield the portion of the trip mechanism disposed within the housing from falling debris.

16. The circuit breaker of claim 15 wherein the first and second housing members include side wall portions having co-operable slots and tabs, respectively, with the tabs extending into the slots to maintain the side wall portions in close proximity.

* * * * *